United States Patent [19]

Munson

[11] 4,256,077

[45] Mar. 17, 1981

[54] MARBLE SHOOTER DEVICE

[76] Inventor: Mark R. Munson, 6149 Vale St., Baton Rouge, La. 70812

[21] Appl. No.: 929,513

[22] Filed: Jul. 31, 1978

[51] Int. Cl.[3] ..... F41F 1/00

[52] U.S. Cl. ..... 124/26; 124/38

[58] Field of Search ..... 124/26, 27, 37, 38, 124/16, 41 R; 273/69, 129 R, 119 R

[56] References Cited

U.S. PATENT DOCUMENTS

| | | | |
|---|---|---|---|
| 583,541 | 6/1897 | McGee | 273/119 R |
| 658,319 | 9/1900 | Krebs | 273/119 R |
| 689,586 | 12/1901 | Haskell | 273/69 |
| 1,189,060 | 6/1916 | Clark | 273/69 |
| 1,608,447 | 11/1926 | Wade | 273/119 R |
| 2,196,549 | 4/1940 | Colaluca | 124/16 |
| 2,791,210 | 5/1957 | Vog et al. | 273/69 |
| 3,246,895 | 4/1966 | Traill | 273/69 |
| 3,572,311 | 3/1971 | Baer | 124/41 R |
| 3,858,882 | 1/1975 | Fox | 273/69 |
| 3,897,061 | 7/1975 | Grattan | 273/69 |

*Primary Examiner*—Richard C. Pinkham
*Assistant Examiner*—T. Brown
*Attorney, Agent, or Firm*—David L. Ray; Edgar E. Spielman, Jr.

[57] ABSTRACT

This invention relates to a marble shooter device which features: a frame having two elongated sides attached together at one of their ends in a spaced-apart relationship by a front end frame piece and attached together at their outer ends in spaced-apart relationship by a rear end frame piece; a barrel mounted to the end frame pieces and between and substantially parallel to the elongated sides, the barrel having a loading port on its upper side for loading the barrel with a marble and a barrel trigger notch in the top of the barrel and rearward of the loading port, and a pair of slots on opposite sides of the slot and rearward of the barrel trigger notch; a striker which is fittable within the barrel which has at least one striker trigger notch on its upper side; a power source attached to the frame and the striker to propel the striker towards the front end of the barrel; a trigger attached to the frame, the trigger extending into the trigger notch to contact and hold the striker in a rearward position by engaging the striker trigger notch; and a spring for biasing the trigger to a position whereby the striker is held in a rearwardly position when the trigger engages the striker trigger notch.

4 Claims, 6 Drawing Figures

MARBLE SHOOTER DEVICE

BACKGROUND OF THE INVENTION

The game of marbles is well known to almost every child. Generally speaking, to be an effective marble player most childen have to attain an age whereby their hands are large enough and their coordination mature enough to effectively "shoot" the marble while playing the game. Oftentimes younger children would like to play the game, however, since they lack the size and coordination required, they oftentimes cannot play.

It is an object of this invention, therefore, to provide a device by which a younger child may be able to play the game of marbles along with older children.

THE INVENTION

This invention relates to a marble shooter device which features: a frame having two elongated sides attached together at one of their ends in a spaced-apart relationship by a front end frame piece and attached together at their other ends in spaced-apart relationship by a rear end frame piece; a barrel mounted to the end frame pieces and between and substantially parallel to the elongated sides, the barrel having a loading port on its upper side for loading the barrel with the marble and a barrel trigger notch in the top of the barrel and rearward of the loading port, and a pair of slots on opposite sides of the slot and rearward of the barrel trigger notch; a striker which is fittable within the barrel which has at least one striker trigger notch on its upper side; a power means attached to the frame and the striker to propel the striker towards the front end of the barrel; trigger means attached to the frame, the trigger means extending into said trigger notch to contact and hold the striker in a rearward position by engaging the striker trigger notch; and means for biasing the trigger to a position whereby the striker is held in a rearwardly position when the trigger means engages the striker trigger notch.

These and other features of this invention contributing satisfaction in use and economy in manufacture may be more fully understood from the following description of a preferred embodiment of the invention when taken in connection with the accompanying drawings, in which identical numerals refer to identical parts and in which.

Figure 1:
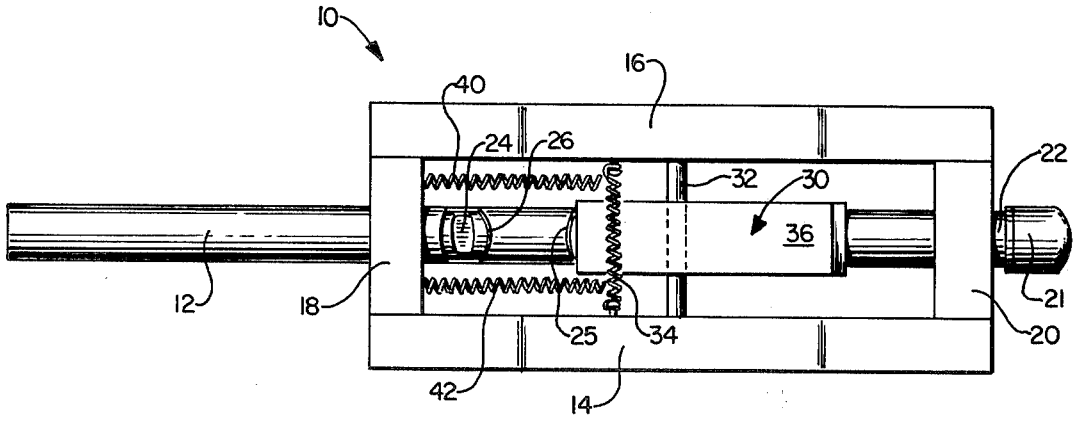
FIG. 1 is a top plan view of an embodiment of this invention.
Figure 2:
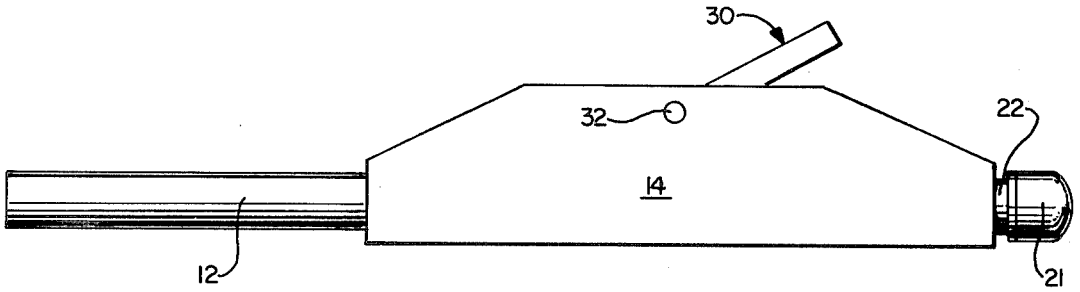
FIG. 2 is a side elevational view of the embodiment shown in FIG. 1.
Figure 3:
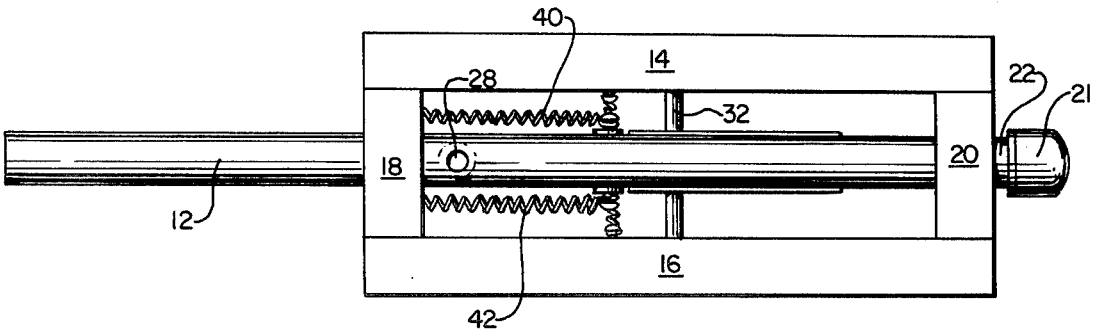
FIG. 3 is a bottom plan view of the embodiment shown in FIG. 1.
Figure 4:
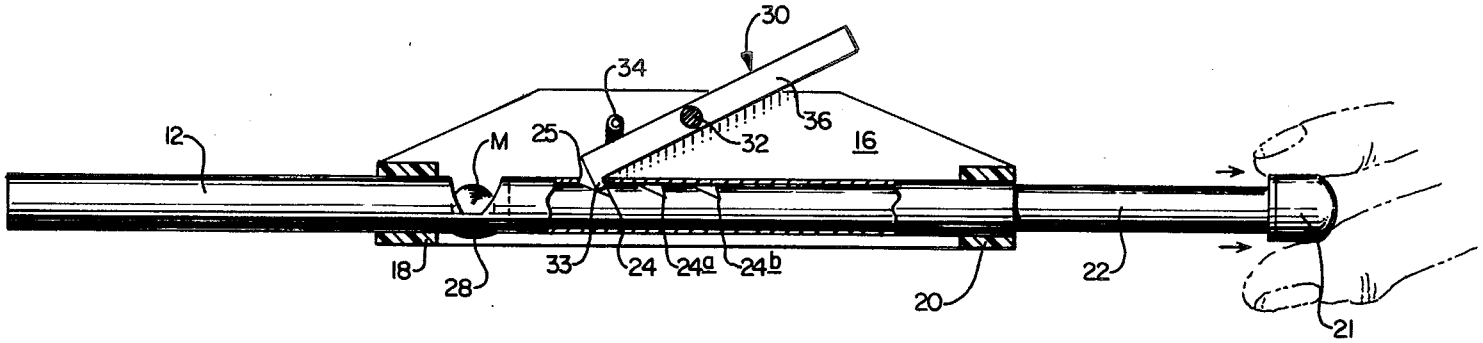
FIG. 4 is a cut a way view of the embodiment shown in FIG. 1 with the striker in the cocked position.
Figure 5:
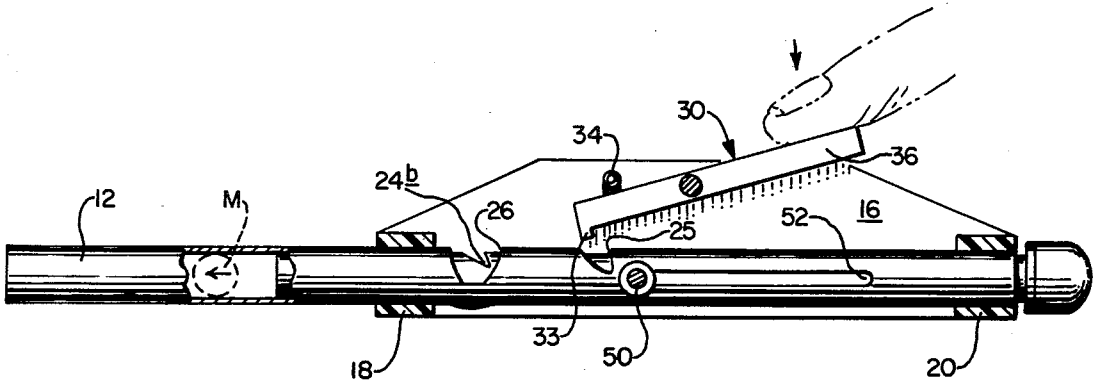
FIG. 5 is a partial cut away view of the embodiment shown in FIG. 1 showing the trigger in the release position and the striker in the firing position.

Referring now to FIGS. 1–6, it can be seen that a marble shooter device of this invention, generally designated by the numeral 10, has a frame having two elongated sides 16 and 14 which are connected at their ends in a spaced-apart relationship by front end frame piece 18 and rear end frame piece 20. The frame for the device of this invention may be made of any suitable material such as wood, plastic or metal. Mounted within the frame and held by front end frame piece 18 and rear end frame piece 20 is barrel 12. As can be seen in FIGS. 1–5, barrel 12 extends the length of the frame and projects forward of front end frame piece 18. On the upper side of barrel 12 is loading port 26 which is located just aft of front end frame piece 18. Directly beneath loading port 26 is aperture 28. Loading port 26 is dimensioned so that a marble may pass therethrough and be placed on aperture 28. Aperture 28 is dimensioned so that the marble will not roll out of aperture 28 and will be held in position so that it may be struck by striker 22 hereinafter described. Barrel 12 additionally has barrel trigger notch 25 on its upper side which notch is located rearward of loading port 26. Barrel trigger notch 25 will permit engagement of trigger 30 with striker 22 as hereinafter described. Barrel 12 additionally has a pair of slots on opposite sides which are rearward of barrel trigger notch 25. One of these slots, slot 52, is shown in FIG. 5. The other slot is identical thereto and is opposite slot 52 on the other side of barrel 12. These slots will allow for proper motion of striker 22 as will be discussed.

Striker 22, as can be seen from the drawings, fits within barrel 12. Striker 22 has at its rearmost end striker stop 21 which is dimensioned to have a diameter larger than the inside diameter of barrel 12. By having such a stop, striker 22 is prevented from moving too far forward down barrel 12. Striker 22 has on its upper side at least one striker trigger notch. For the embodiment shown in the drawings, as can be seen in FIG. 4, striker 22 has striker trigger notches 24, **24*a* and 24*b*. As can be appreciated from FIG. 4, by having a plurality of notches the force applied to a marble can be adjusted by the user of the device of this invention. Giving forward motion to striker 22 are springs 42 and 40. These springs are attached to frong end frame piece 18 and to pins which are attached to striker 22. One of these pins is shown in FIG. 5 and is labeled 50, it being understood that an identical pin is located on the other side of striker 22** but is not shown in the drawings. These pins ride within the barrel slot.

Figure 6:
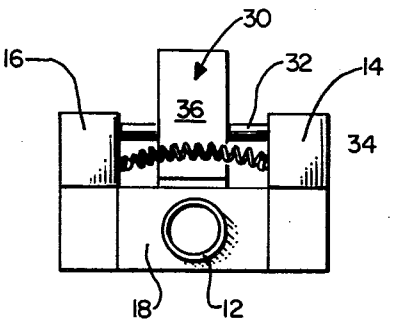
FIG. 6 is a front elevational view of the embodiment shown in FIG. 1.

Trigger 30 is provided so that the user of this invention can fire striker 22 by mere depression of trigger 30. Trigger 30 is held in a downwardly biased position by spring 34 which is attached to the two frame sides. FIGS. 4–6 show that trigger 30 is pivotally mounted to sides 16 and 14 by means of pivot pin 32. Trigger 30 is L-shaped, having a long leg 32 and a short leg 33. Long leg 32 has positioned atop it spring 34 hereinabove described. Short leg 33 is utilized to make holding contact with the striker trigger notches as shown in FIG. 4.

As is the case with the frame of the device of this invention, the striker, barrel and trigger can be made of any suitable material, for example, wood, plastic or metal. The springs, of course, should be high quality springs capable of experiencing multiple flexing without failure.

In operation, the user of device 10, as is shown in FIGS. 4 and 5, will grasp stop 21 and pull striker 22 to the rear until short leg 33 of trigger 30 is seated into the desired striker trigger notch. Since spring 34 maintains trigger 30 in a downward position, the user may release his grasp on stop 21. Marble M is then fed through loading port 26. Marble M will rest in aperture 28 and will not have a tendency to roll up and down barrel 12. Once device 10 has been properly aimed to the user's satisfaction at the object marble, trigger 30 is depressed as is shown in FIG. 5. By depressing trigger 30, striker 22 is urged rapidly forwardly by springs 40 and 42 causing it to strike marble M and propel same through barrel 12 and in a direction towards the object marble.

As can be appreciated, the device of this invention is the paragon of simplicity not requiring complicated assembly or production techniques. Therefore, not only does the device of this invention provide a highly suitable toy for a younger child but also provides a relatively inexpensive one.

What is claimed is:

1. A marble shooter device comprising:

a. a frame having two elongated sides attached together at one of their ends in a spaced-apart relationship by a front end frame piece and attached together at their other ends in spaced-apart relationship by a rear end frame piece;

b. a barrel mounted to said end frame pieces and between and substantially parallel to elongated sides, said barrel having;

i. a loading port on its upper side for loading said barrel with a marble, ii. a barrel trigger notch in the top of said barrel and rearward of said loading port, iii. marble holding means beneath said loading port for releaseably holding said marble when said marble is loaded, and iv. a pair of slots on opposite sides of said barrel and rearward of said barrel trigger notch;

c. a striker slidably positioned within said barrel, said striker having at least one striker trigger notch on its upper side;

d. a power means attached to said frame and said striker to propel said striker towards the front end of said barrel, said point of attachment of said power means to said striker being rearward and adjacent to said striker trigger notch;

e. trigger means attached to said frame, said trigger means extending into said trigger notch to contact and hold said striker in a rearward position by engaging said striker trigger notch; and f. means for biasing said trigger to a position whereby said striker is held in a rearwardly position when said trigger means engages said striker trigger notch.

2. The device of claim 1 wherein said power means is a pair of springs attached to said front end frame piece, said springs extending along each side of said barrel and attaching to a pin carried on each side of said striker.

3. The device of claim 1 wherein said trigger comprises an L-shaped piece having its long leg pivotally connected to said sides and having its short leg engagable with said striker trigger notch through said barrel trigger notch.

4. The device of claim 3 wherein said means for biasing said trigger comprises a spring attached between said elongated sides and over said trigger means at a point on the upper surface of said long leg at a point forward of said pivot point.

* * * * *